US005566912A

United States Patent [19]

Durchschlag

[11] Patent Number: 5,566,912

[45] Date of Patent: Oct. 22, 1996

[54] DEVICE FOR LOCKING OF MOVABLE SWITCH PARTS

[75] Inventor: Gerald Durchschlag, Zeltweg, Austria

[73] Assignee: VAE Aktiengesellschaft, Vienna, Austria

[21] Appl. No.: 442,261

[22] Filed: May 16, 1995

[30] Foreign Application Priority Data

May 16, 1994 [AT] Austria ..... 1009/94

[51] Int. Cl.[6] ..... F01B 7/00

[52] U.S. Cl. ..... 246/448; 246/452

[58] Field of Search ..... 246/401, 435 R, 246/442, 448, 450, 451, 452; 74/110; 411/21, 22, 30, 31, 44, 45, 48; 188/67, 82.8, 82.3

[56] References Cited

U.S. PATENT DOCUMENTS

| | | | |
|---|---|---|---|
| 1,270,824 | 7/1918 | Holdeman | 246/452 |
| 4,842,225 | 7/1989 | Carmes | 246/452 |
| 4,952,106 | 8/1990 | Kubogochi et al. | 411/48 |
| 5,221,167 | 6/1993 | Girkin et al. | 411/45 |
| 5,239,933 | 8/1993 | Murphy et al. | 411/43 |
| 5,292,091 | 3/1994 | Callegari et al. . | |

FOREIGN PATENT DOCUMENTS

| | | | |
|---|---|---|---|
| 603156 | 6/1994 | European Pat. Off. | 246/448 |
| 245511 | 11/1965 | Germany . | |
| 2450802 | 4/1976 | Germany . | |
| 531 | 4/1889 | Switzerland | 246/452 |

*Primary Examiner*—S. Joseph Morano
*Attorney, Agent, or Firm*—Cushman Darby & Cushman

[57] ABSTRACT

In a device for locking end positions of movable switch parts, in particular, a switch lock, two relatively movable parts are displaceable into a position non-positive in respect of at least one direction of movement. The relatively movable parts are formed by a tube and a pin axially guided within the tube. In addition, separate locking elements formed by heads of flexible tongues are provided.

8 Claims, 8 Drawing Sheets

17
15
32
2
4
1
3
9
33
10
20
1
10
9
33
4
3
2
32
16
18
15
2
4
12
15
1
4
2
16
17
15
34
4
16
18

17
15
31
16
18
39
1
4
2
33
10
9
38
3

17
15
16
18
40
41
42
43
44
33
1
2
3
4

DEVICE FOR LOCKING OF MOVABLE SWITCH PARTS

BACKGROUND OF THE INVENTION

1. Field of the Invention

The invention relates to a device for locking end positions of movable switch parts, in particular, a switch lock, in which two relatively movable parts are displaceable into a positive and force-transmitting position in respect of at least one direction of movement, separate locking elements being provided.

2. Prior Art

For locking movable switch parts, in particular, with designs in the form of a switch lock, a device for coupling and locking (switch locking) using clamp-like catch units has become known. With a lock designed in that manner, two relatively movable parts are provided, one part being guided in a recess of the other part and having to be pivoted relative to the other part in the plane of displacement to assume either of the respective end positions. With other configurations, pivoting out of the plane of displacement is required. On the whole, all of the known switch lock devices are designed in a manner that a more or less complex off-axial movement is required and that the parts constituting the lock lie bare, thus being subject to contamination. Such risk of contamination, in particular, may impede safe locking.

SUMMARY OF THE INVENTION

The invention aims at providing a device of the initially defined kind, which enables a completely closed mode of construction protected against the penetration of dirt and which, moreover, avoids off-center stresses of the locking elements affecting service life. To achieve this object, the configuration according to the invention essentially consists of relatively movable parts comprised of a tube and a pin guided within the tube wherein the tube, over a portion of its axial length, is provided with axially extending slits forming flexible tongues, and wherein the free ends of the flexible tongues each carry a head having a wall thickness exceeding the wall thickness of the tube. Inasmuch as the relatively movable parts are relatively movable in the axial direction only, since one of the two parts is guided by a structural part axially guided in the other part, the risk of off-center and eccentric forces initially is avoided. A completely closed configuration protected against the penetration of dirt is achieved by the fact that one of the structural parts is a tube embracing the other structural part. Proper locking with such a design is effected by separate locking elements formed by enlarged heads of flexible tongues. The locking elements in that case are dimensioned such that they are each displaceable between the inner contour of the externally arranged structural part and the outer contour of the internally arranged structural part during displacement, locking being accomplished by the radial dislocation of the heads of the flexible tonuges.

A particularly simple configuration in this respect is provided by guiding the relatively movable parts in a stationary external tube including at least one axial region on the internal jacket that has an enlarged inner width. Such an external tube, in particular, embraces a locking element that may be displaced outwardly in the radial direction, thus safely preventing the penetration of dust or dirt also on that site. In addition, such an external tube being another self-contained protected structural part offers the possibility of providing, if desired and according to a preferred embodiment, a displacement drive, which may be arranged in the stationary external tube.

The relative displacement of the internally arranged pin-shaped structural part axially guided within the tube in respect of the externally arranged tube-shaped structural part movable in the axial direction may be limited in a simple manner in that the tube-shaped part movable along its axis comprises at least one inwardly projecting abutment cooperating with a stop provided on the pin-shaped part along its axis. Such an inwardly projecting abutment moreover, has the advantage that a spring may be arranged between the inwardly projecting abutment and the stop of the pin-shaped structural part. Advantageously, such a spring is designed as a helical spring, which design may serve as a shift aid, since, when associating more than one device according to the invention between movable rails, both of the springs are, at first, compressed during the displacement procedure, which results in a dead center position, one spring thus being reexpanded in the respective end position. The appropriate layout of spring characteristics will provide for assistance in the shifting movement from the dead center position. Furthermore, the advantage is achieved that a switch operated in this manner or equipped with a locking element of this type may be burst open opposite to the force of a spring.

It is particularly advantageous if the pin-shaped displaceable part is designed to be stepped so as to have a smaller diameter over a portion of its length. Over such a portion of the length of the pin-shaped structural part, the locking elements, in their radially inwardly dislocated position, may be displaced in the longitudinal direction of the pin so as to enable a forward movement and a rearward movement, respectively, during the displacement movement without thereby reaching a locking position. It is only after having reached the larger diameter region of the pin via a conical surface that the locking elements are able to slide into an annular groove or recess of the external tube. Locking occurs only in that second position.

In order to enable the displacement of the locking elements without causing any wear, the configuration may be chosen such that the difference in diameter between the smaller diameter of the pin-shaped part and the inner diameter of the stationary external tube is larger than the wall thickness of the heads of the flexible tongues, and the difference in diameter between the larger diameter of the pin-shaped part and the interior of the stationary tube, is larger than the wall thickness of the flexible tongues.

With a view to providing appropriate mounting and guiding of the locking elements and reducing the wear of the locking elements, the configuration preferably is chosen such that the wall thickness of the displaceable part is larger than half of the wall thickness of the heads of the flexible tongues.

As already mentioned, locking with the device according to the invention is effected in that the locking elements are shifted outwards in the radial direction so as to be inserted into an annular groove or recess provided on the internal periphery of the stationary external tube.

Depending on admissibility and on railway legal regulations, the locking means according to the invention also may be employed directly as an actuating means for the adjustment of a switch, wherein it is advantageously provided that one of the relatively axially movable parts, in particular, the pin-shaped part, is connected with a displacement drive, the stationary external tube being particularly suitable for arranging such a displacement drive, as already pointed out above.

BRIEF DESCRIPTION OF THE DRAWINGS

The invention will be explained in more detail by way of exemplary embodiments schematically illustrated in the drawing, wherein.

DETAILED DESCRIPTION OF THE PREFERRED EMBODIMENTS

Figure 1:
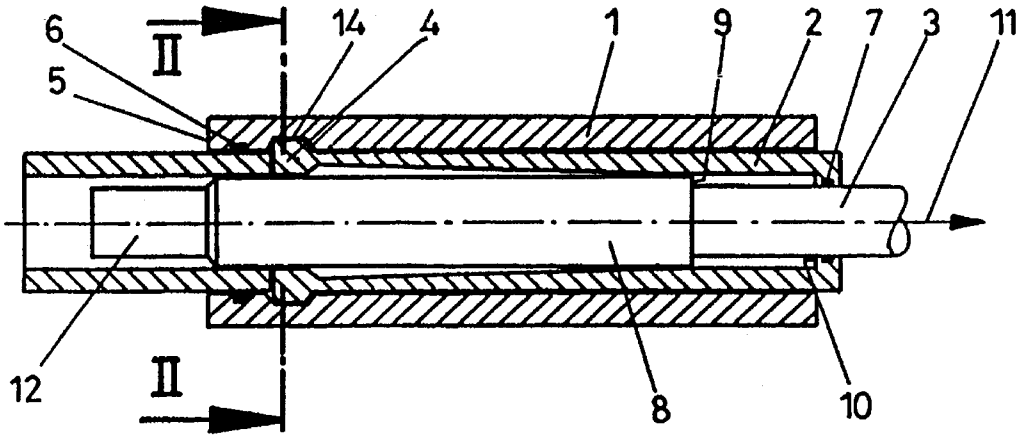
FIG. 1 is a section through a first embodiment of a device according to the invention for locking end positions of movable switch parts.
Figure 2:
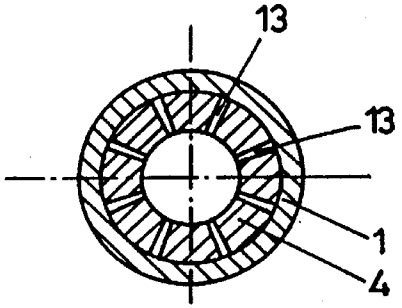
FIG. 2 illustrates a section along line II—II of FIG. 1.

In FIGS. 1 and 2, sections through a device for locking end positions of movable switch parts are illustrated, wherein relatively movable parts in the form of a tube 2 and a pin 3 axially guided within the tube 2 are arranged within an external tube 1. The external tube 1 forms a casing and is stationarily arranged. The relatively movable parts, i.e., the tube 2 as well as the pin 3, are connected with a movable rail part and/or a drive, as will become clearly apparent hereinafter. The tube 2 and the pin 3 cooperate via locking elements 4. The external tube or casing 1 is closed on its front end 5, wherein sealing means may be provided between the tube-shaped displaceable part 2 and the external tube 1, or the front end 5, respectively, as well as between the pin 3 and the tube 2. Such sealing means are indicated by 6 and 7.

The pin 3 has a region 8 whose outer diameter corresponds to the inner diameter of the tube 2. Following region 8, the pin 3 is formed with an offset region defining a shoulder which serves as a stop 9 which cooperates with an inwardly projecting abutment 10 of the tube 2 as the pin 3 is moved along a predetermined displacement path. After displacement of the pin 3 in the direction of the arrow 11, the locking elements 4, by the stop 9 cooperating with the abutment 10, move into a similarly offset region 12 of the pin, thus enabling further displacement of the pin 3 and of the tube 2 in the direction of the arrow 11. The locking elements 4, when displaced radially outwards, more into annular grooves 14. The cooperation of the stop 9 with the abutment 10 and the subsequent displacement both of the pin 3 and of the tube 2 make possible forward or rearward movements when shifting a movable switch part, as will become even more clearly apparent hereinafter.

Figure 3:
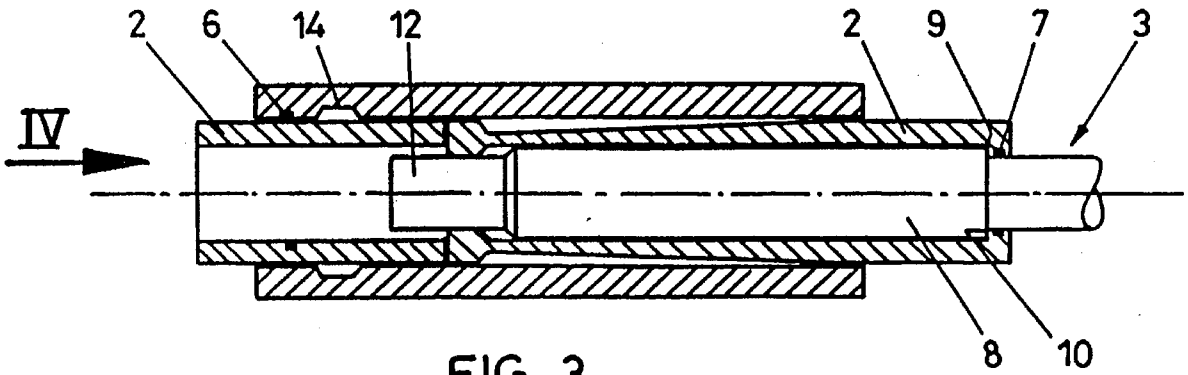
FIG. 3 shows a section through a second position of the locking device according to FIG. 1 in an illustration analogous to FIG. 1.
Figure 4:
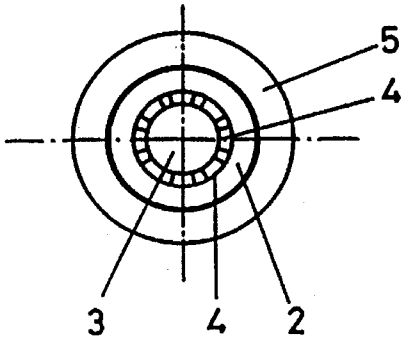
FIG. 4 is a view in the direction of arrow IV of FIG. 3.

In the illustration according to FIGS. 3 and 4, the device for locking end positions of movable switch parts is in a position displaced in the direction of the arrow 11 according to FIG. 1 and it is clearly apparent that the pin 3 also has caused a displacement of the tube 2 in the sense of arrow 11 due to the stop 9 cooperating with the abutment 10 of the tube 2. Due to the fact that the locking elements 4, after a first displacement of the pin 3, move into the offset region 12 of the pin, displacement of the tube 2 beyond the position shown in FIG. 1 is possible.

From what is illustrated in FIGS. 2 and 4 it can be seen that the locking elements 4 are designed as heads of flexible tongues, the individual flexible tongues being separated by axial slits 13.

Figure 5:
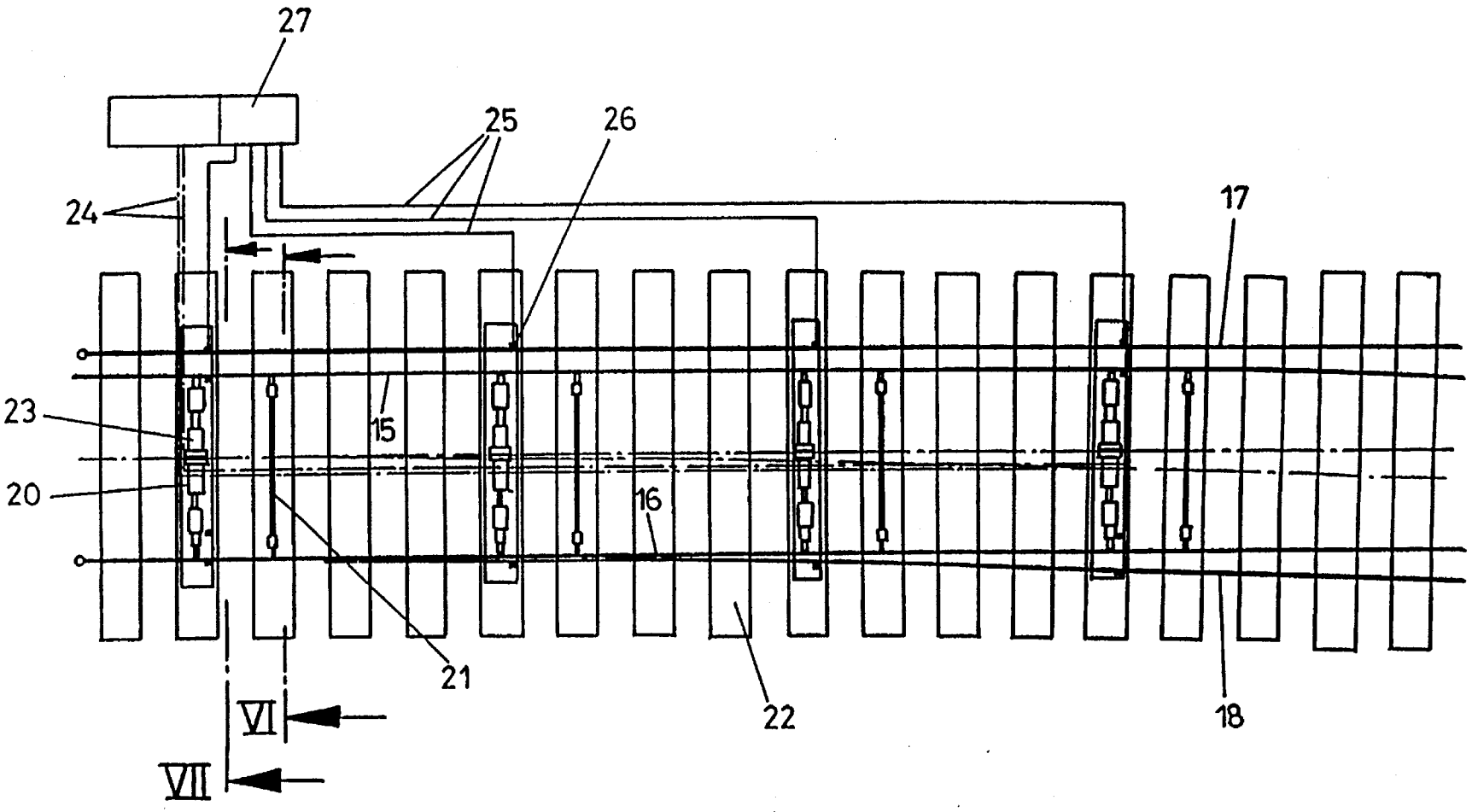
FIG. 5 is a schematic top view of a switch with devices according to the invention for locking end positions of movable switch parts being employed.

In FIG. 5, a switch is schematically illustrated, wherein shifting of the tongue rails 15, 16 each into a position engaging at the stock rails 17, 18, respectively, is effected via a plurality of locks generally denoted by 20 each comprising the devices illustrated in detail in FIGS. 1 to 4, as will be indicated in more detail hereinafter. In addition, stretching rods 21 are provided between the tongue rails 15, 16. The stock rails 17 and 18 as well as the tongue rails 15, 16 rest on sleepers 22 in a generally known manner and are supported by means of sliding plates or bearing plates. Drives 23 provided between the tongue rails 15 and 16 serve to effect adjustment of the same, cooperating with the devices illustrated in FIGS. 1 to 4. In this context, FIG. 5 schematically indicates control lines 24 for the adjustment drives. Furthermore, evaluation lines 25 are indicated, cooperating, for instance, with end switches 26 and constituting a monitoring means for an engaged tongue rail. A common evaluation and control means is indicated by 27.

Figure 6:
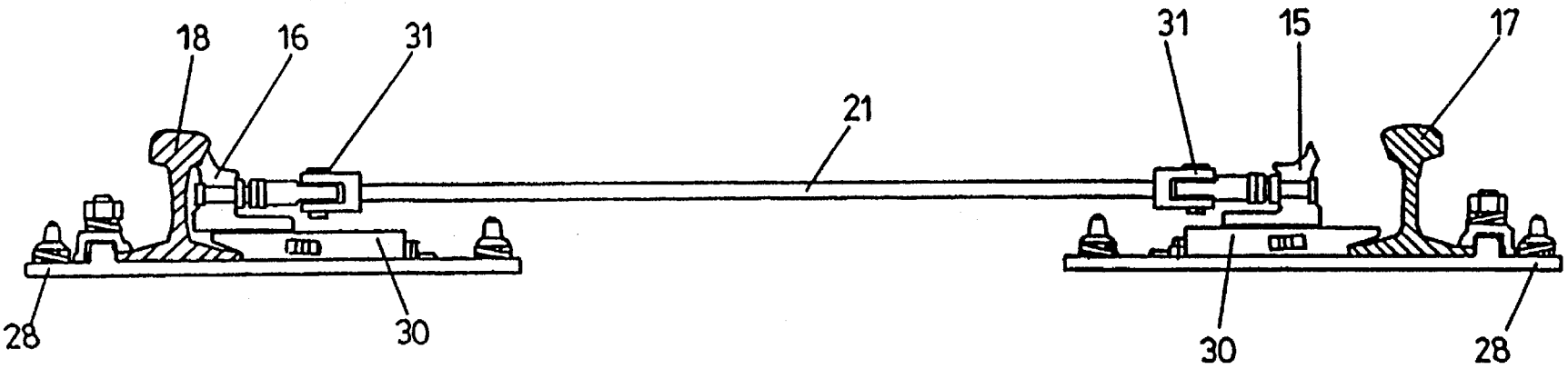
FIG. 6 is a section along line VI—VI of FIG. 5.
Figure 7:
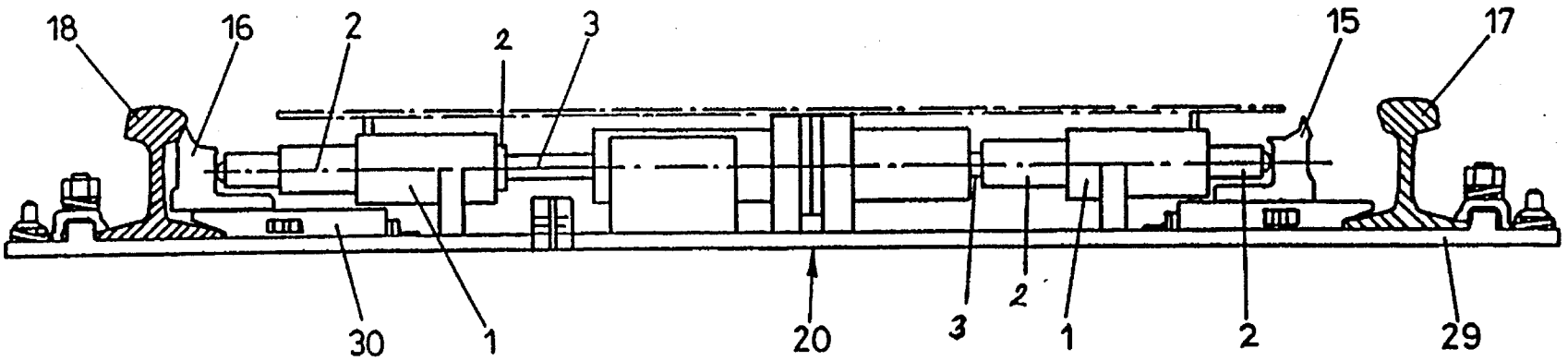
FIG. 7 is a section along line VII—VII of FIG. 5, wherein, in the embodiment according to FIGS. 6 and 7, a pushing lock for switches having stretching rods between the movable tongue rails is illustrated.

From FIGS. 6 and 7, the fixation of the stock rails 17 and 18 on ribbed plates or bearing plates 28 and 29 is clearly apparent. FIG. 6, furthermore, depicts the device of the stretching rod 21 between the tongue rails 15 and 16, assuring the desired distance between the tongue rails 15 and 16. The tongue rails are displaceably arranged on a slide chair 30 in a known manner.

From FIG. 7 it is clearly apparent that each of the tongue rails 15 and 16 is associated with a device for locking end positions of movable switch parts, wherein the displaceable tube 2 guided within the stationary external tube 1 of a device of this kind is pressed at the inner face of the rail foot of the pertaining tongue rail 15 and 16, while the pin 3, displaceably guided within the tube 2, cooperates with a schematically indicated drive 20 located between the tongue rails. Appropriate actuation of the pin-shaped displaceable parts 3 in the devices for locking the end positions of movable switch parts effects shifting of the tongue rail.

The embodiment illustrated in FIGS. 6 and 7, of a pushing lock including a stretching rod 21, may be employed, in particular, with high-speed switches, no bursting open of the switches being desired, but fluttering of the tongue rails being avoided by locking on both sides. Merely pushing contact of the device is utilized for locking end positions of the tongue rails 15 and 16, and no length-compensating connection pieces are required. Furthermore, locking on both sides is obtained by additionally using the stretching rod coupled to the tongue rails 15 and 16 via joints 31.

In FIGS. 8*a* to 8*d* a pulling lock is schematically illustrated, partially sectioned, in various positions of the rails, using a device for locking end positions of movable switch parts. In this embodiment, the tongue rails 15, 16 are directly connected with the tube-shaped displaceable parts 2 of the pertaining device for locking the end position of the tongue rail via connection pieces 32. The movable pin-shaped parts 3, in turn, are connected with a drive 20 arranged between the tongue rails. In this embodiment it is, furthermore, provided that compression springs 33 are arranged between the stop 9 of the pin-shaped part 3 and the associated abutment 10 of the tube-shaped part, which compression springs are either compressed or expanded depending on the respective position assumed.

Figures 8A, 8B, 8C, 8D:
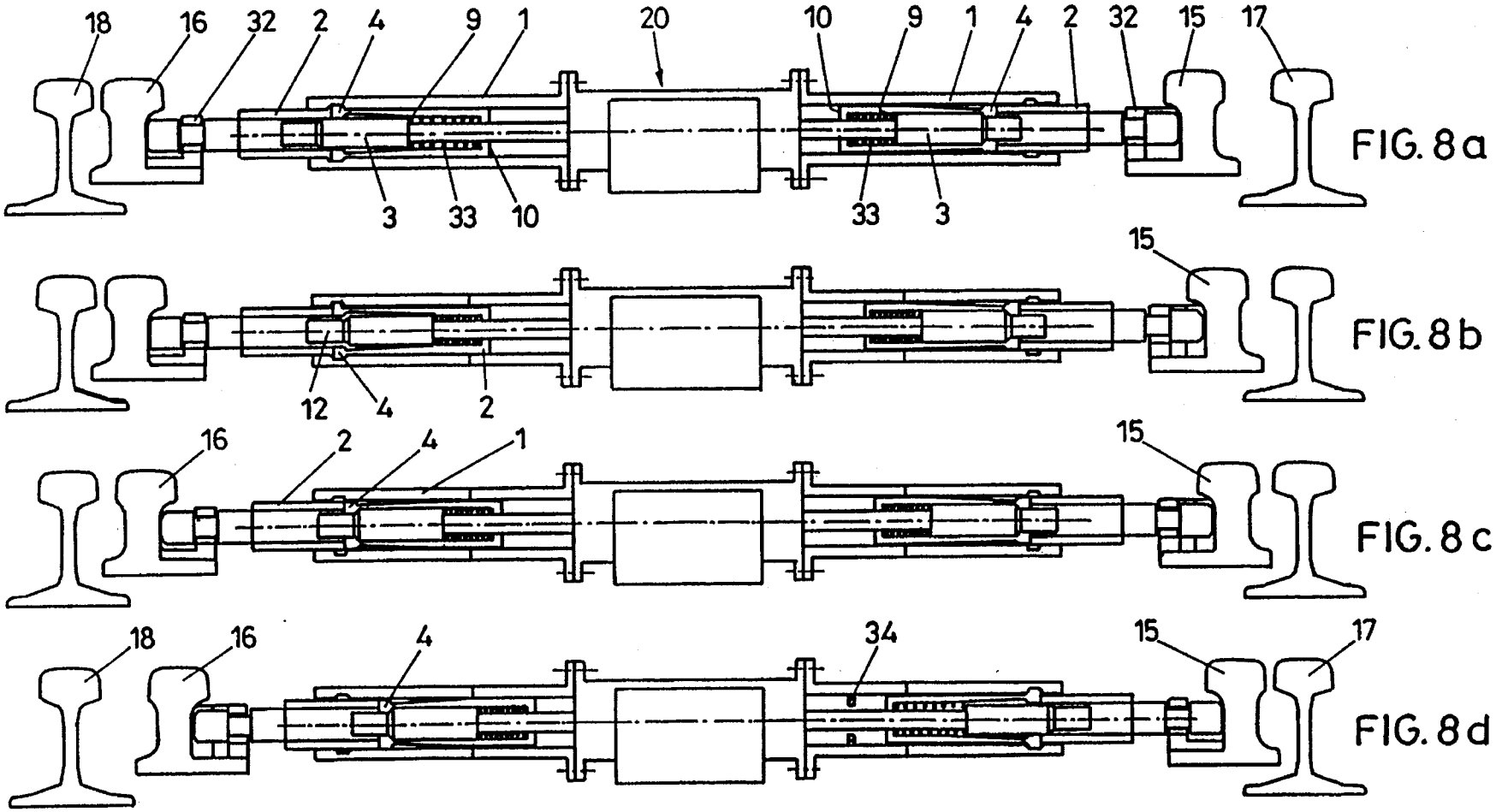
FIGS. 8*a* to 8*d* partially sectionally illustrate different positions of a pulling lock using devices according to the invention for locking end positions of movable switch parts.

FIGS. 8*a* to 8*d* illustrate the sequence of a shifting movement of the tongue rails 15 and 16, respectively. When actuating the connected pin-shaped displacable parts 3 by means of the displacement drive 20, compression of the compression spring 33 illustrated on the left-hand side of the drawing is effected departing from the position illustrated in FIG. 8*a* and simultaneously initiating the displacement of the tongue rail 15 illustrated on the right-hand side with the tongue rail 16 still remaining in its original position. It is only in the position represented in FIG. 8*b* that the displacement of the tube-shaped part 2 is cleared by lowering the locking elements 4 into the offset region 12 of the pin-shaped part 3 such that, departing from that position, the tongue rail 16 is moved at the same time the tongue rail 15 is displaced, as is illustrated in FIG. 8*c*.

In FIG. 8*d*, the second end position is illustrated, in which the tongue rail 16 is located at a distance from the stock rail 18, while the tongue rail 15 is in its position next to the stock rail 17. A stop 34 is, furthermore, indicated for limiting the displacement of the pin-shaped parts 3. On the whole, it has been shown that, by coupling two devices for locking end positions of movable switch parts, a forward movement and a rearward movement, respectively, each may be accomplished in the shifting movement, assisted by springs 33.

The embodiment illustrated in FIGS. 8*a* to 8*d* is intended for switches capable of being burst open, since the open tongue at first is burst open and the lock is not arrested on that side.

Figure 9A:
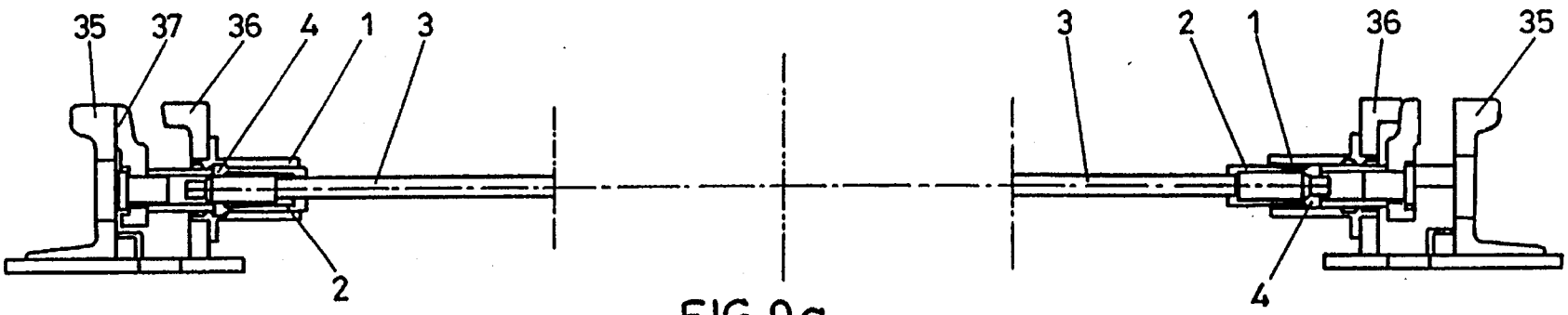
FIGS. 9*a* to 9*b* represent sections likewise through a pulling lock using devices according to the invention with grooved rails.
Figure 9B:
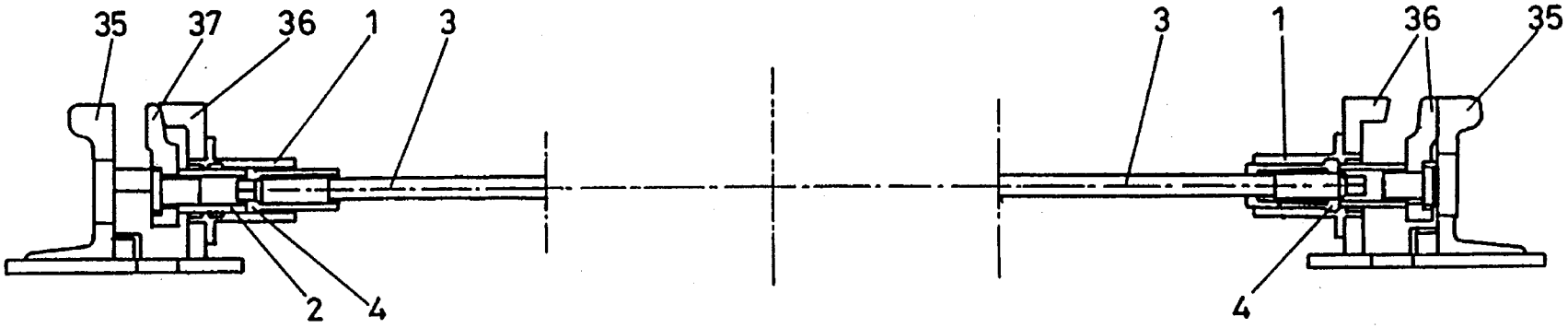

In FIGS. 9*a* and 9*b*, the end positions of a similar pushing lock for a grooved rail is illustrated. The rigid elements of the grooved rail are denoted by 35 and 36, while the movable rail, or the movable rail part, is denoted by 37. The inwardly arranged rigid rail part 36 is traversed by the tube-shaped part 2, which is connected with the movable rail 37. The stationary external tube 1, furthermore, is arranged on the internally located part 36 of the grooved rail. In this embodiment, the drive is designed in a manner similar to the embodiment according to FIGS. 8*a* to 8*d*, the assistance by compression springs having been eliminated in this embodiment.

Figures 10, 11A, 11B, 11C, 11D:
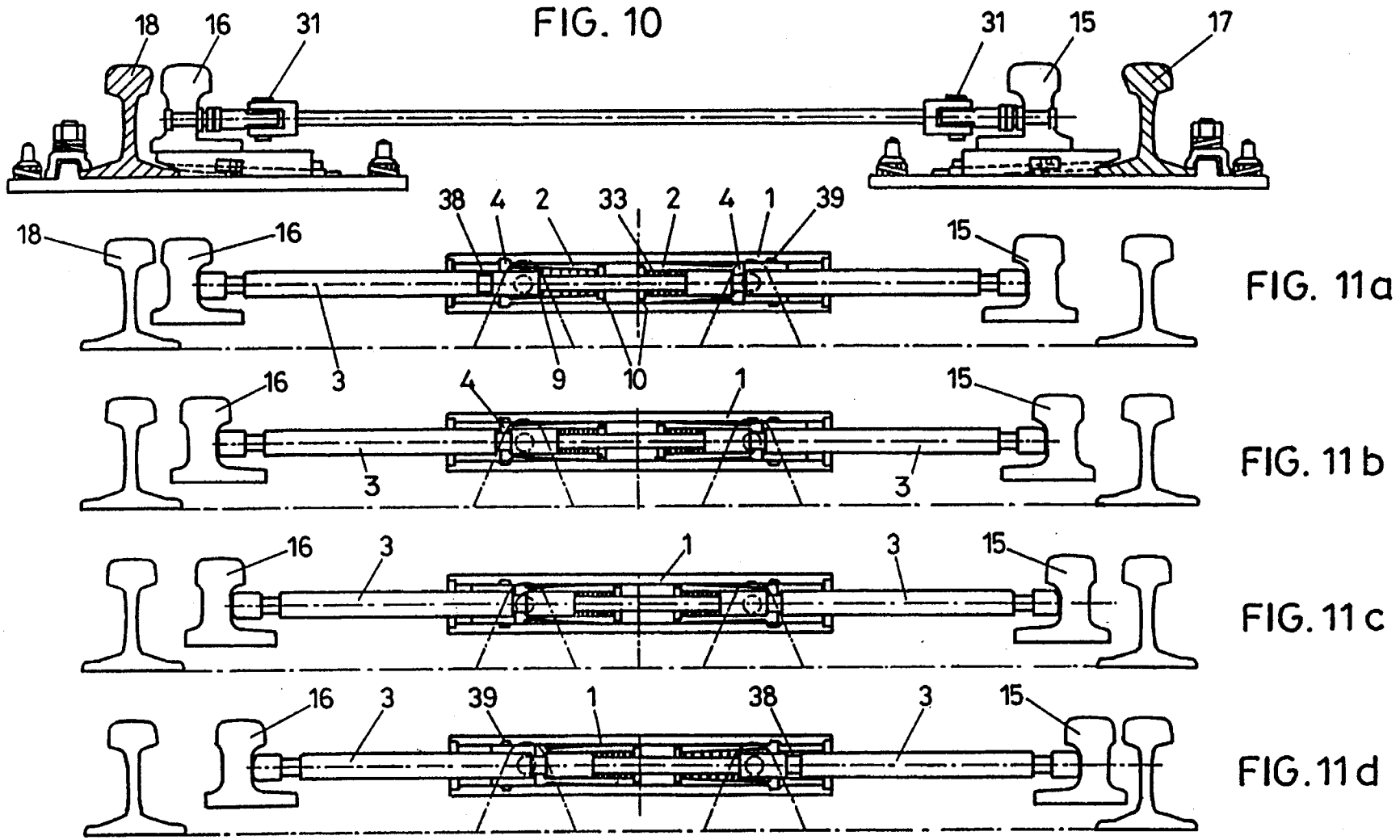
FIG. 10 is an illustration similar to FIG. 6, showing the use of a stretching rod as a shift aid for movable tongue rails while employing the device according to the invention for locking end positions of movable switch parts.
FIGS. 11*a* to 11*d*, in illustrations similar to FIGS. 8*a* to 8*d*, depict a pushing shift aid while employing the device according to the invention for locking end positions of movable switch parts.
Figures 12A, 12B, 12C, 12D:
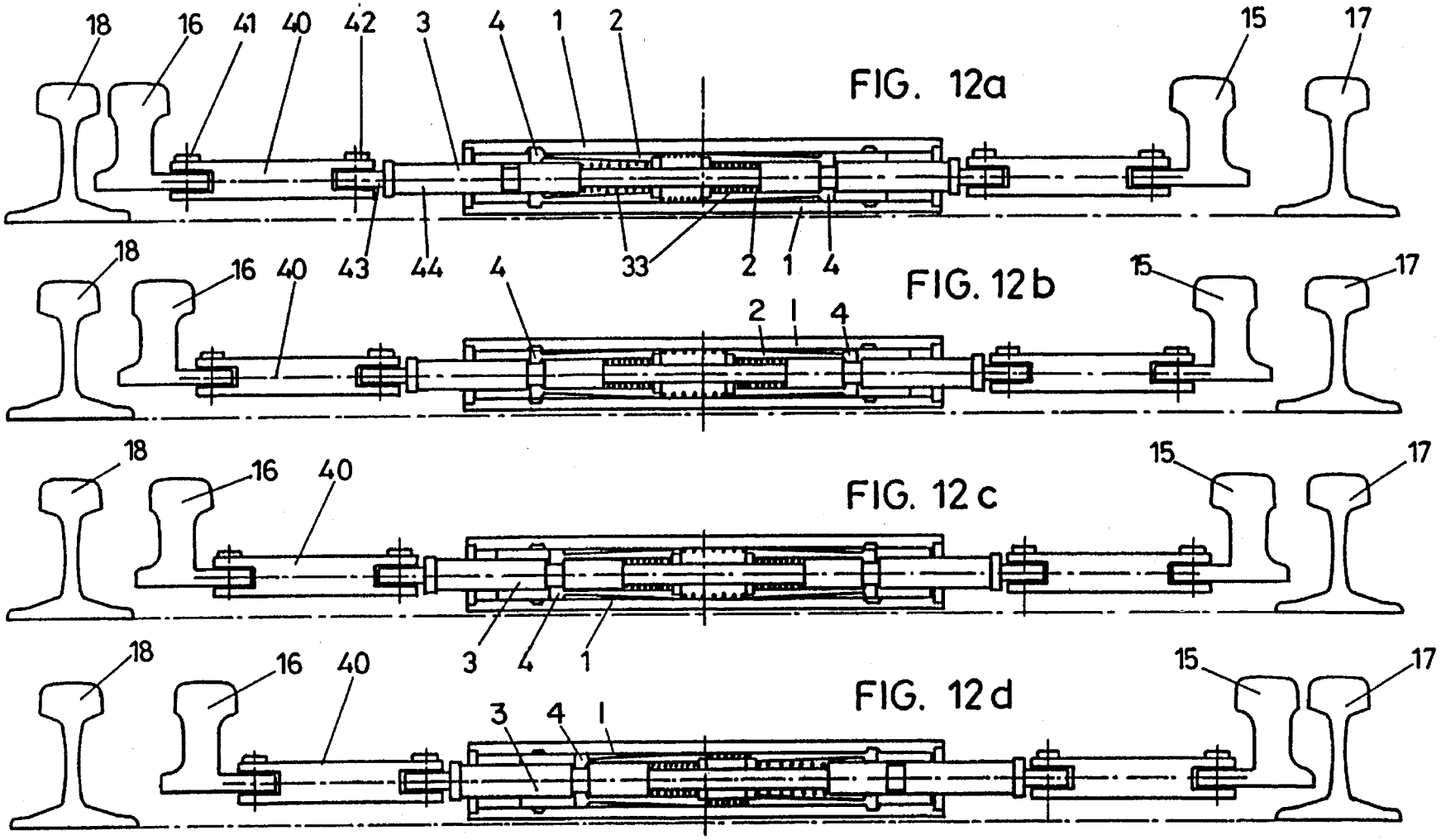
FIGS. 12*a* to 12*d*, in illustrations similar to FIGS. 11*a* to 11*d*, depict a pushing and pulling shift aid while employing the device according to the invention for locking end positions of movable switch parts.
Figure 13:
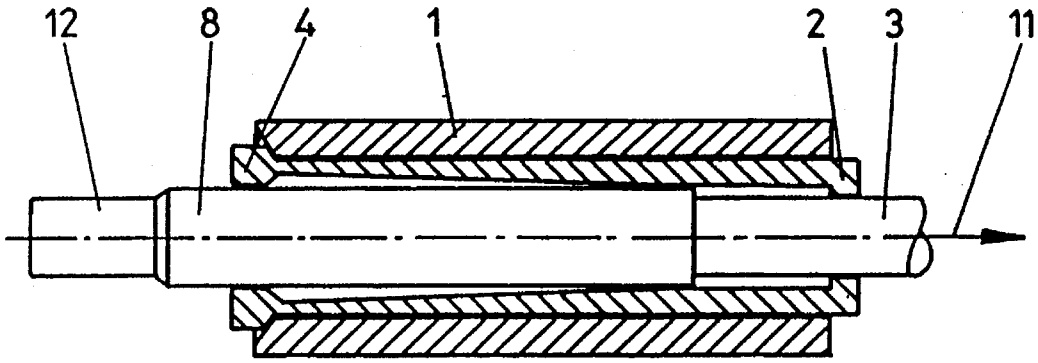
FIGS. 13 to 16 represent a modified embodiment in illustrations analogous to FIGS. 1 to 4.
Figure 15:
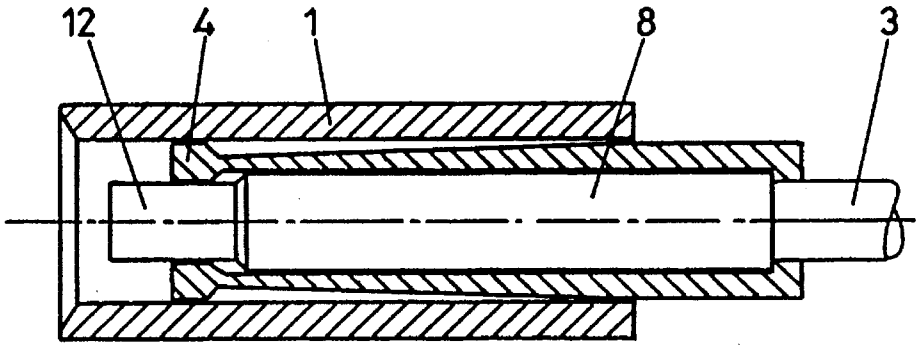
Figure 14:
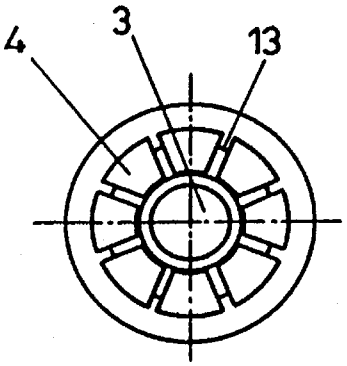
Figure 16:
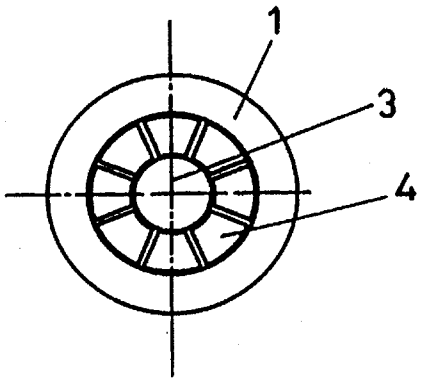

In FIG. 10, a stretching rod 21 is illustrated between the tongue rails 15 and 16 in a manner analogous to FIG. 6.

A related pushing shift aid is illustrated in FIGS. 11*a* to 11*d*, wherein the pin-shaped displaceable parts 3, in this embodiment, each engage the internal surfaces of the rail feet of the tongue rails 15 and 16. The tube-shaped part 2 again is displaceably mounted in the stationary external tube or casing 1, a compression spring 33 again being provided between each stop 9 of the pin-shaped movable part and abutment 10 of the tube 2. In this embodiment, the pin 3 includes a peripheral groove 38 corresponding to the offset region 12 of the locks of the preceding embodiments, into which the locking elements 4 may be inserted in the appropriate positions of the connected pin-shaped parts 3 so as to enable the displacement also of the tube-shaped part 2 within the external tube 1. In correspondence with the peripheral groove 38, the external tube 1, on its internal periphery, includes a peripheral groove 39 corresponding to the groove 14 in the preceding embodiments. When shifting the tongue rails from the starting position shown in FIG. 11*a* into the second end position represented in FIG. 11*d*, the accumulated spring force is imparted to the closing tongue rail, i.e., to the tongue rail 15 illustrated on the right-hand side of FIGS. 11*a* to 11*d*, during displacement, as is illustrated in FIGS. 11*b* and 11*c*.

In the representation of FIGS. 12*a* to 12*d*, another shift aid using the device for locking end positions of movable switch parts is illustrated, wherein, as opposed to the configuration according to FIGS. 11*a* to 11*d*, connection between the pin-shaped elements 3 and the rail feet of the tongue rails 15, 16 is realized via articulation pieces 40 hingedly joining the rail foot and the respective pin-shaped displaceable element 3 at 41 and 42, respectively. This produces a pushing and pulling shift aid so that one can do without a stretching rod. The shifting movement takes place as in the embodiment illustrated in FIGS. 11*a* to 11*d*, a connection element 43 of the articulation piece 40 additionally being screwable into a recess 44 of the end of the pin-shaped element 3 to enable exact adaptation to the position of the respective tongue rail. Also in this embodiment, the accumulated spring force of the springs 33 is imparted to the closing tongue rail during displacement.

In the embodiments illustrated in FIGS. 11 and 12, a separate drive is used for the shifting movement, which is known per se and is not illustrated in detail.

On the whole, it may be said that all of the components of the device for locking end positions of movable switch parts, i.e., the external tube 1, the tube-shaped movable part 2 as well as the pin-shaped movable part 3, are comprised of cylindrical parts, thus being relatively movable coaxially with one another and one within the other. Moreover, the stationary external tube can be sealed easily.

Furthermore, all of the locking elements or elements of the shift aid are relatively movable only in the longitudinal direction so as to provide for a simple overall construction, mounting relative to the rail being accomplished on a sleeper between the movable tongue rails.

Eight locks typically are used for a switch, such as a high-speed switch having a large radius of curvature.

In the illustrations of FIGS. 13 to 16, the reference numerals of FIGS. 1 to 4 have been retained unchanged. Instead of the annular groove 14, the free end of the external tube 1 acts as a stop for locking. With this configuration, the introduction of force must be effected laterally at the tube 2 in a manner not illustrated, such configuration having not all of the advantages of the configuration according to FIGS. 1 to 4 in respect of sealing and central force introduction.

What I claim is:

1. A switch part locking device comprising:

a stationary tube;

a displaceable tube disposed within the stationary tube and moveable with respect to the stationary tube in an axial direction;

a pin disposed within the displaceable tube and moveable with respect thereto in said axial direction so as to be operatively connected to a switch part; and means responsive to positions of the pin relative to the displaceable tube for locking the displaceable tube to said stationary tube and unlocking it therefrom so as to lock said switch part in end positions.

2. A device as set forth in claim 1, wherein said displaceable tube includes a plurality of slits in the wall of said tube extending along a portion of the axial length of the displaceable tube so as to form flexible tongues, each of said tongues being provided with a free end carrying a head having a thickness exceeding the thickness of the wall of the displaceable tube.

3. A device as set forth in claim 2, wherein said stationary external tube is provided along its interior wall with an annular recess for receiving the heads of the flexible tongues to lock the displaceable and stationary tubes against relative movement in the axial direction.

4. A device as set forth in claim 3, wherein said pin is cylindrical and includes a first portion, having a first diameter, joined with a second portion, having a second diameter, to form a shoulder adapted to serve as a stop; and wherein said displaceable tube is provided with an inwardly projecting abutment at one of its ends through which said pin projects, said pin being moveable with respect to the displaceable tube until said shoulder engages the abutment whereupon further movement of the pin unlocks the displaceable tube from the stationary tube and moves the displaceable tube in said axial direction.

5. A device as set forth in claim 4, further comprising a spring located within said displaceable tube and positioned between the abutment and said stop.

6. A device as set forth in claim 5, wherein said spring is helical.

7. A device as set forth in claim 1, further comprising a displacement drive connected to said pin for moving the pin in said axial direction.

8. A device as set forth in claim 7, wherein said displacement drive is arranged within the stationary tube.

* * * * *